US006061909A

United States Patent [19]

Laskowski

[11] Patent Number: 6,061,909

[45] Date of Patent: May 16, 2000

[54] METAL PANEL WITH FLANGED HOLES AND PROCESS OF FABRICATION

[75] Inventor: Leonard Laskowski, Lockport, Ill.

[73] Assignee: Ready Metal Manufacturing Co., Chicago, Ill.

[21] Appl. No.: 08/903,971

[22] Filed: Jul. 31, 1997

Related U.S. Application Data

[63] Continuation-in-part of application No. 08/508,419, Jul. 31, 1995, abandoned, which is a continuation-in-part of application No. 08/088,078, Jul. 6, 1993, abandoned.

[51] Int. Cl.[7] ..... B21D 28/24

[52] U.S. Cl. ..... 29/896.6; 29/897.32; 83/30; 248/220.31; 248/220.41; 248/220.42; 248/220.43; 248/225.21

[58] Field of Search ..... 29/896.6, 897.32; 83/30; 248/220.31, 220.41, 220.42, 220.43, 225.21

[56] References Cited

U.S. PATENT DOCUMENTS

| | | | |
|---|---|---|---|
| D. 189,402 | 12/1960 | Harty | 248/220.3 |
| D. 212,021 | 8/1968 | Gregory | D34/5 |
| 2,621,807 | 12/1952 | Rendich | 248/220.3 |
| 3,191,777 | 6/1965 | Willits, Jr. | 211/87 |
| 3,322,287 | 5/1967 | Ragir | 211/87 |
| 3,452,959 | 7/1969 | Ishikawa | 248/220.3 |
| 3,506,261 | 4/1970 | Gregory | 272/60 |
| 4,029,282 | 6/1977 | Dauth | 248/221.1 |
| 4,319,730 | 3/1982 | Thalenfeld | 248/220.41 |
| 4,733,552 | 3/1988 | Lefils | 72/405 |
| 4,762,299 | 8/1988 | Langeller | 248/220.4 |
| 5,035,388 | 7/1991 | Nagel | 248/220.31 |
| 5,180,128 | 1/1993 | Massey | 248/220.41 |

FOREIGN PATENT DOCUMENTS

| | | | |
|---|---|---|---|
| 1084577 | 1/1955 | France | 248/220.3 |
| 714703 | 9/1954 | United Kingdom . | |

*Primary Examiner*—Nasser Ahmad
*Attorney, Agent, or Firm*—Dvorak & Orum

[57] ABSTRACT

A peg board panel for supporting a bracket or other generally available hanging element. The panel is comprised of a fabricated metal panel having a front surface, a side surface, a rear surface, and an array of holes extending through the panel. The holes are first punched and then extrusion formed to create an upstanding annular flange extending away from the rear surface of the panel by a predetermined distance or extent. A bracket having a hook is supported by the panel by extending the hook through the hole. The annular flange strengthens the panel and provides a rigid support for the bracket. The hook also has an extent which is equivalent to the predetermined extent of the flange so that no play exists between the bracket and the panel, eliminating brackets that sag or pull out of the panel. The panel diametrical hole sizes and spacing can be varied along the panel.

4 Claims, 2 Drawing Sheets

METAL PANEL WITH FLANGED HOLES AND PROCESS OF FABRICATION

This application is a continuation-in-part of application Ser. No. 08/508,419 filed Jul. 31, 1995 now abandoned, which was a continuation in part of Ser. No. 08/088,078, filed Jul. 6, 1993, now abandoned.

BACKGROUND OF THE INVENTION

1. Field of the Invention

The present invention relates to an extrusion process for forming a metal panel having an array matrix of holes therein for supporting a bracket or other hanging element within the holes. More specifically, the present invention relates to a fabricated metal panel having an array of flanged holes formed through an extrusion due process for supporting a bracket or hanging element wherein the length of the flange is formed to specifically match an extent of the anchoring hook so that "play" between the bracket and panel is eliminated.

2. Discussion of Prior Art

Panels for supporting brackets generally comprise a rigid material having a matrix array of bores extending through the panel. The brackets generally include a hook that may be extended through one of the bores to secure the bracket to the panel. When a load is placed on the bracket, for instance by an article suspended therefrom, stress is imparted to the area surrounding the bore resulting in a deformation of the panel and a drooping of the bracket. It has been suggested to overcome the foregoing problem with a rigid U-shaped metal wall bracket having a series of openings for receiving and retaining hanging clips. A U-shaped bracket, however, has the disadvantage that it is limited to thin horizontal strips anchored to a wall, thereby severely restricting the placement of the hanging clips. A plurality of U-shaped brackets may be arranged parallel to one another, but such an arrangement distracts from the aesthetic quality of the wall. A U-shaped bracket has the further disadvantage that it requires several manufacturing steps, including the formation of the openings and the bending of edge portions to form the U-shape. A U-shaped bracket also requires a hanging clip that is specifically manufactured to engage with the openings of the bracket. Another problem is that the brackets are typically manufactured to fit holes of only a few dimensional sizes and with relatively no regard to the thickness of the panel. Thus, the end user typically is forced to settle with a panel/bracket combination wherein the brackets easily pull out of the panel holes or droop when articles are hung from the brackets.

Other panels have been proposed for supporting hanging brackets including a flexible apertured panel comprised of a thermoplastic polymer sheet. A flexible panel may be applied directly to an irregular or curved wall surface with an adhesive. The flexible panel, however, requires a raised embossment into which the hanging hook is inserted and has the disadvantage that the initial cost of fabrication is extremely high. The raised embossments may be undesirable for the reason that moisture and particulate matter may accumulate thereon. There is therefore a need for an advancement in the field of peg board panels that overcomes the problems discussed above.

It is an object of the present invention to provide a novel peg board panel having a hole or bore extending through the peg board panel with an annular flange formed about a perimeter of the hole on the backside of the panel, where the flange is formed with regard to rigidly supporting the bracket so as to eliminate play between the peg board and the bracket.

It is a further object of the present invention to provide a novel peg board panel that is rigid and resistant to stress caused by a bracket wherein the bracket does not sag or droop during loading of the bracket.

It is a further object of the present invention to provide a novel process for fabricating the novel peg board panel.

It is also an object of the present invention to provide a novel peg board panel that can be manufactured so as to be versatile with respect to receiving brackets of varying size and dimension so as to allow different loading applications along differing areas of the peg board.

The present invention is directed toward a novel peg board panel for supporting a bracket or other generally available hanging element. The peg board panel is comprised of a fabricated metal panel having a front surface, a side surface, a rear surface, and an array of holes extending through a panel. The holes each include a concentric annular flange extending from the rear surface of the panel. A bracket having at least one anchoring hook is supported by the panel by extending the hook through the hole. The upstanding annular flange strengthens the panel and is provided with a length or extent that is essentially coextensive with the extent of the hook so that the hook and flange cooperate to provide a rigid and slack-free support for the bracket.

These and other objects, features and advantages of the present invention will become apparent upon consideration of the following detailed description and the accompanying drawings described below.

DESCRIPTION OF THE INVENTION

Figure 1:
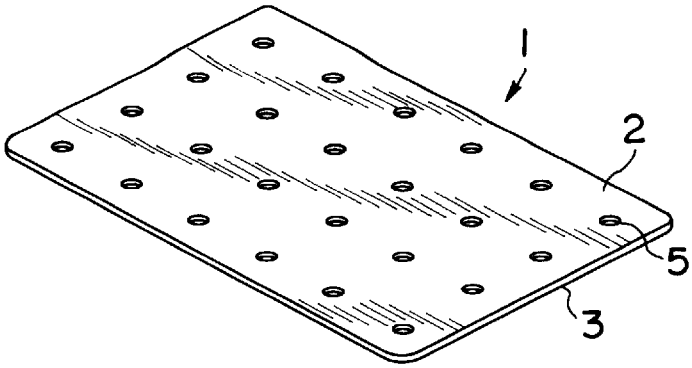
FIG. 1 is a front surface perspective view of a metal peg board panel.
Figure 2:
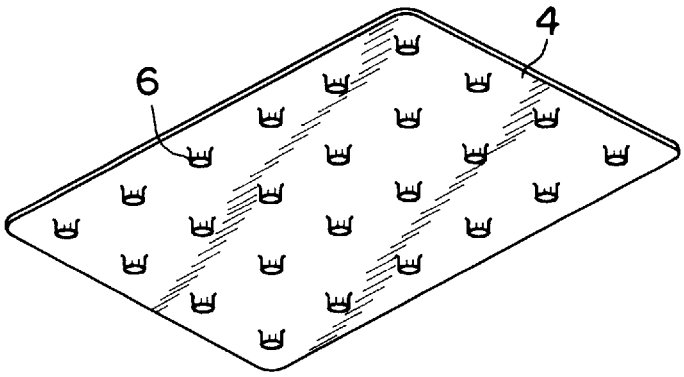
FIG. 2 is a rear surface perspective view of the metal peg board panel of FIG. 1.
Figure 3:
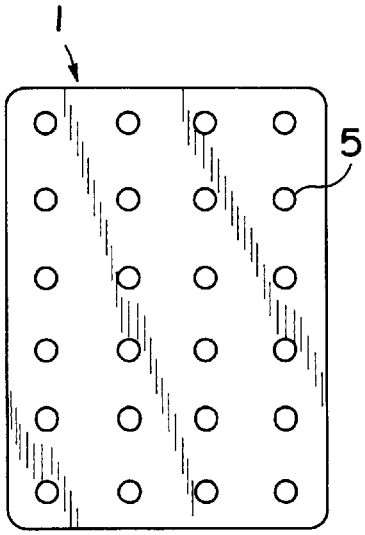
FIG. 3 is a front surface view of the metal peg board panel.
Figure 6:
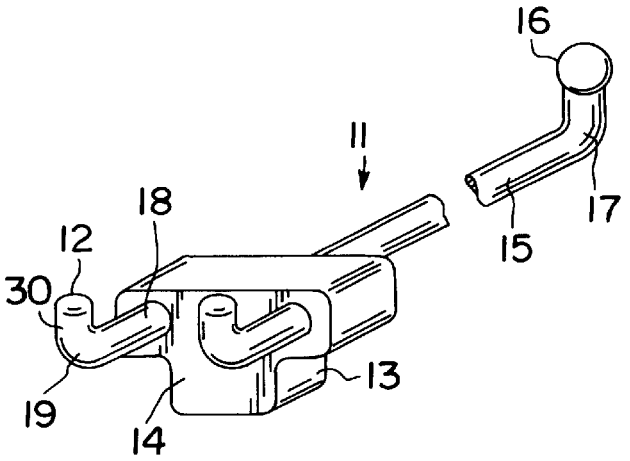
FIG. 6 is a rear perspective view of the bracket of FIG. 4.

FIGS. 1 and 2 are perspective views of a metal peg board panel 1 generally comprising a front surface 2, a side surface 3, a rear surface 4 and an array of bores or peg holes 5. FIG. 3 is a front view of the panel 1 having an array of holes 5 forming a matrix array. One or more of the holes 5 of the matrix array may support a bracket 11 shown in FIGS. 4 and 6 and discussed further below.

Figure 4:
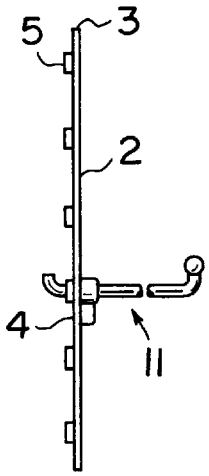
FIG. 4 is a side surface view of FIG. 3 including a bracket supported by the peg board panel.
Figure 5:
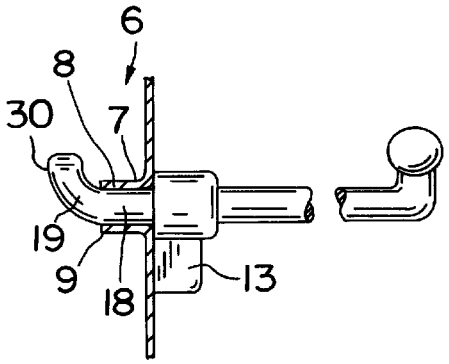
FIG. 5 is a partial sectional view of FIG. 4.

FIG. 4 is a side view of FIG. 3, and FIG. 5 is a partial sectional view of FIG. 4 showing the hole 5 and an upstanding annular flange 6 associated with each hole 5. The upstanding annular flange 6 extends from the rear surface 4 of the panel 1 and includes a base section 7 defining a transition between the rear surface 4 and an annular collar section 8 that is delimited by an annular lip 9 at a terminating edge of the annular collar 8. The upstanding annular flange 6 increases the strength of the panel 1 and supports the bracket 11 as discussed below. The annular flange 6 is drawn through the rear surface 4 of the panel 1 by a novel extruding process discussed below.

The panel 1 is generally fixedly disposed along a substantially planar surface, for example a vertical wall, so that there exists a space between the rear surface 4 of the panel 1 and the planar surface or wall. A mounting spacer (not shown) may be disposed between the panel 1 and the wall to maintain a space between the wall and the panel 1. The panel 1 may be secured to the wall by a lag bolt or other means known in the art or alternatively the panel 1 may be mounted on a fixed display stand. The panel 1 may then serve as a support for a bracket 11 generally of the peg board type shown in FIGS. 4 and 6. The bracket 11 includes one or more pegs or hooks 12 that extend outwardly away from a rear surface 13B of anchor 13 for anchoring said bracket to panel 1. Each hook is comprised of a base 18 that is delimited by or at a bend 19, which in turn defines a tip 30. The base 18 extends from anchor 13 by an extent substantially equivalent to the extent of annular collar section 8 of flange 6. The front surface 13A of anchor 13 includes a support arm 15 extending outwardly away from that side of the anchor 13. The support arm 15 may extend perpendicular to anchor 13 or at an angle thereto. The support arm 15 may comprise a single shaft having a "U" or "Y" shaped claw at an end thereof, or also have a knob 16 or a bend 17 or both at an end thereof in order to secure articles disposed on or suspended from the support arm 15.

In operation, a vertically disposed panel 1 supports the bracket 11 by extending the hook 12 through the hole 5 from the front surface 2 of the panel 1. The annular collar 8 engages the hook 12 about the base 18 to provide support to the bracket 11. The flange is formed such that annular collar section 8 is provided with an extent that is predetermined according to the extent of base 18 of support bracket 11. Manufacturing the flanges as such prevents the bracket from having any slack or free-play when inserted into panel 1. Advantageously, this means that brackets 11 will no longer sag or droop downwardly when loaded, or accidentally pulled out upon removal of a tool, device, package, etc. which is suspended from the bracket. When inserted into panel 1, tip 30 of the hook 12 extends substantially parallel to the rear surface of the panel 1 and the annular lip 9 engages the hook 12 about or at the hook bend 19 to prevent the bracket 11 from moving and dislodging from the panel 1. The anchor rear surface 12B will engage the front surface 2 of the panel to prevent the support arm 15 from being displaced through the hole 5 and also to provide additional support to the bracket 11. Due to the close tolerances between the extent of annular collar 8 and base 18, it can be appreciated that annular flange 6 of the panel 1 adequately supports the bracket 11 to fixedly dispose and maintain the arm 15 substantially perpendicular or at a fixed angle to the front surface of the panel 1 when an article is suspended from the arm 15.

Figure 7:
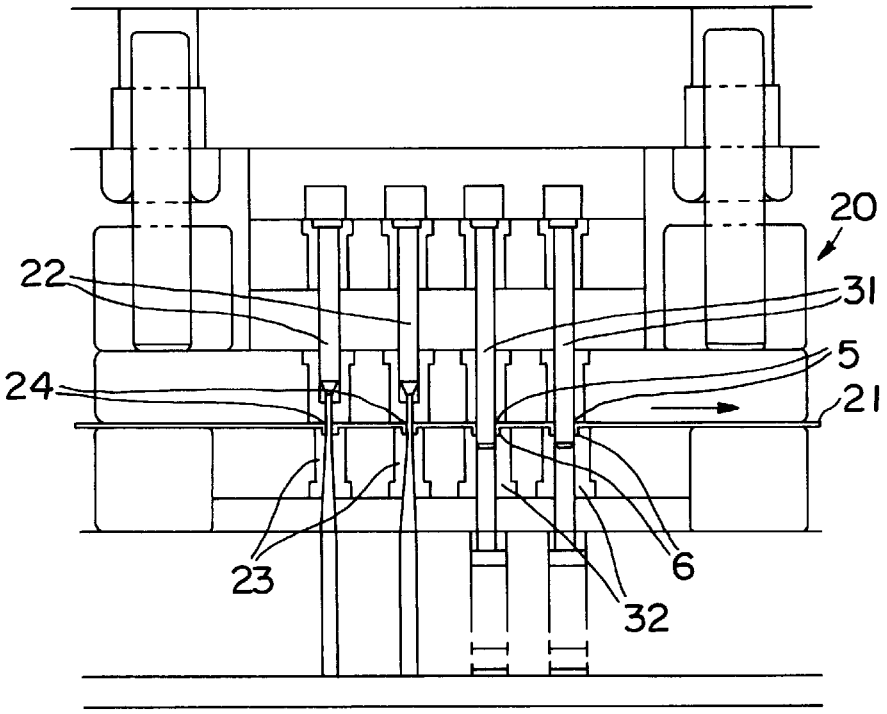
FIG. 7 is a side view of a punch and die apparatus for forming a matrix array of holes in a blank metal sheet.

The panel 1 is preferably fabricated from a blank metal sheet 21 of rectangular configuration having any dimension, said sheet having a front surface 21F, a side surface 21S and a top and bottom surface 21T, 21B respectively. The holes 5 in the peg board panel 1 are formed by an extruding apparatus 20 shown in a side view of FIG. 7. The apparatus 20 includes at least two arrays or rows of pilot hole punches 22 arranged above surface 21T and corresponding pilot hole dies 23 arranged below surface 21B and in parallel to punches 22A. The pilot hole punch and dies are disposed such that they span the width 21W of plate 21 although this part is clearly shown in the drawing. The arrays or rows of extrusion punches 31 and corresponding extrusion dies 32 are also arranged in parallel with each other and with the pilot punch arrays as shown above and below metal sheet 21. The extrusion punch and dies are downstream of the pilot hole punch and dies, along the direction of the heavy arrow, and they too span the width 21W of any size plate 21 inserted into apparatus 20. The blank metal sheet 21 is incrementally positioned through apparatus 20 relative to the pilot punch arrays and the extrusion arrays along the direction indicated by the heavy arrow in FIG. 7. As the blank metal sheet 21 is fed, front surface 21F first approaches the two pilot punch arrays such that pilot hole punches 22 and pilot hole dies 23 operatively cooperate to form at least two rows of pilot holes 24 in the blank metal sheet 21 during one simultaneous operation of each punch and die. The blank metal sheet is then again incrementally advanced in the direction of the heavy arrow to position the two rows of pilot holes 24 in alignment with the extrusion arrays 31 such that the extrusion punch and dies 31, 32, are coextensive with each hole 24, whereby an amount of metal material immediately surrounding the pilot hole 24 is drawn into each respective punch and die such that the upstanding annular flange 6 is extrusion formed into metal sheet 21. During the formation of holes 5, the extruding punches 31 draw blank metal sheet material through the pilot holes 24, downwardly into the corresponding extruding dies 32 to extrude the annular flanges 6. The process is repeated as sheet 21 advances, thereby creating a panel 1 having holes 5 arranged in a uniform matrix array, although other hole configurations may also be arranged. The lateral distance between the individual finished holes 5 of each hole in a row may remain uniformly spaced, or they may be varied by changing the configuration of the punch and die assemblies such that at least two rows of holes will be formed with one particular lateral spacing, while the succeeding rows thereafter can be made with a differing lateral spacing. In addition, the punch and die assemblies can be adjusted such that a spacing between the rows in the longitudinal direction (along heavy arrow) can be changed such that at least every two rows of holes will have one longitudinal distance between the holes of the two rows, while the succeeding rows thereafter can be made to have a differing longitudinal spacing between each two-row set of holes. The variable spacing between respective finished holes and between every two rows of holes allows several different types of brackets to be used on a single panel. Of course, it should be understood that all hole sizes and all lateral and longitudinal spacing between holes can be made uniform.

Finally, the metal panel 1 may be coated with a finish such as paint or other surface covering to enhance the appearance or protect the surface thereof as is known in the art.

The foregoing is a description of the preferred embodiments of the invention enabling one of ordinary skill in the art to make and use the invention. Those of ordinary skill in the art will recognize and understand that various modifications and equivalents of the embodiments of the present invention exist. The present invention therefore is to be limited only by the scope of the appended claims.

What is claimed is:

1. A process for forming a metal panel used in the construction of shelving units, said panel having a longitudinal axis and formed from a metal sheet blank having a pair of spaced longitudinal sides interconnected to a pair of spaced vertical sides, said sheet blank sides delimiting a top and bottom surface of said panel, the process comprising the steps of:

providing at least one row of pilot hole punches and corresponding dies relative to one of said vertical sides of said sheet blank;

providing at least one row of extrusion punches and corresponding dies relative to one of said vertical sides of said sheet blank;

providing at least one row of extrusion punches and corresponding dies in parallel arrangement to said pilot hole punches and dies, said sheet blank generally interposed between said pilot hole punch and dies and said extension punch and dies;

advancing said sheet blank such that said one vertical side lies under said pilot hole punch and dies;

executing a part of said pilot hole punch and dies to punch form a row of pilot holes into said sheet blank, said row of pilot holes extending across said sheet blank, parallel to said vertical sheet side;

advancing said sheet blank so that said row of punched pilot holes is aligned under said extension punch and dies;

executing a part of said extension punch and dies which correspond to said number of pilot holes, whereby an amount of sheet blank material surrounding each of said pilot holes is drawn through each respective pilot hole and into each of said executed extrusion dies such that an upstanding annular flange is extrusion formed about each of said pilot holes, said row of extruded holes adding structural strength to said panel;

successively advancing said sheet blank through said other part of the pilot and extrusion punch and dies such that a series of rowed pilot holes and extruded holes are formed in said sheet blank between said vertical sides.

2. The process of claim 1, wherein said extrusion punch and dies are executed only on selected rows of pilot holes.

3. The process of claim 1, wherein a distance between each of said extruded holes is made to vary from one row to another.

4. The process of claim 1, wherein two rows of pilot holes and extruded holes are formed simultaneously.

* * * * *